United States Patent [19]

Shimizu

[11] Patent Number: 4,572,769

[45] Date of Patent: Feb. 25, 1986

[54] METHOD OF MANUFACTURING TETRAMETHYL AMMONIUM HYDROXIDE

[75] Inventor: Shumpei Shimizu, Kawasaki, Japan

[73] Assignee: Tama Chemicals Co., Ltd., Japan

[21] Appl. No.: 665,524

[22] Filed: Oct. 26, 1984

[30] Foreign Application Priority Data

Nov. 2, 1983 [JP] Japan ..... 58-206427

[51] Int. Cl.[4] ..... C25C 1/00

[52] U.S. Cl. ..... 204/59 R; 204/72; 204/182.4

[58] Field of Search ..... 204/72, 59 R, 180 P

[56] References Cited

U.S. PATENT DOCUMENTS

| | | | |
|---|---|---|---|
| 3,523,068 | 8/1970 | Eisenhauer | 204/72 |
| 4,011,145 | 3/1977 | Haufe | 204/72 |
| 4,394,226 | 7/1983 | Wade | 204/72 |

FOREIGN PATENT DOCUMENTS 4614885 4/1981 Japan .

57-155390 9/1982 Japan .

*Primary Examiner*—John F. Niebling

*Attorney, Agent, or Firm*—Bacon & Thomas

[57] ABSTRACT

A method of manufacturing quarternary ammonium hydroxide by electrolyzing a quarternary ammonium salt in an electrolytic cell whose diaphragm is prepared from a cation exchange membrane, wherein said quarternary ammonium salt is represented by an organic acid salt expressed by the general structural formula:

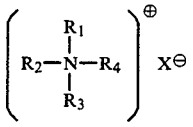

where $R_1$ to $R_4$=methyl radical or ethyl radical (at least $R_1$ to $R_3$ denote the same radical; X represents formic acid).

1 Claim, No Drawings

METHOD OF MANUFACTURING TETRAMETHYL AMMONIUM HYDROXIDE

BACKGROUND OF THE INVENTION

This invention relates to a method of manufacturing quarternary ammonium hydroxide, and more particularly to a method of manufacturing quarternary ammonium hydroxide adapted as a treating agent for the washing of a wafer or the development of a resist layer.

During the manufacture of IC or LSI devices, a treating agent is generally applied, for example, in the washing and etching of the surface of a semiconductor substrate (wafer) and in the development of a resist film. Particularly known among the various treating agents used for the above-mentioned objects, is an organic alkali, such as quarternary ammonium hydroxide, which is free from metal ions, for example, sodium. Particularly in recent years, great demand has been made for quarternary ammonium hydroxide having a high purity and excellent storage stability due to the progress in large-scale integration of semiconductor devices.

To date, quarternary ammonium hydroxide has been manufactured by electrolyzing a salt of quarternary ammonium in an electrolyte cell whose diaphragm is formed of a cation exchange membrane. Said quarternary ammonium salt is provided by a halogenated salt or sulfate ensuring relatively easy synthesis. When, however, it is attempted to manufacture quarternary ammonium hydroxide of great purity by the method involving a halogenated salt, such as an quarternary ammonium salt, the following difficulties are encountered.

(1) The cation exchange membrane has a low capacity for selecting ions and shutting off gases. Consequently, minute amuonts of halogen ions and halogen gases permeate said cation exchange membrane to be carried into the quarternary ammonium hydroxide applied as a cathode solution. When therefore, the quarternary ammonium hydroxide obtained is stored in a widely accepted stainless steal vessel, said vessel is corroded by the highly corrosive halogen ions contained in said quarternary ammonium hydroxide, leading to a decline in the purity of the stored quarternary ammonium hydroxide. Where the quarternary ammonium hydroxide obtained was used as a developer in the manufacture of a semiconductor device, corrosion, etc. of the aluminium interconnection already formed on the semiconductor substrate due to halogen ions, etc. occurred, causing the device to deteriorate.

(2) During the electrolysis of quarternary ammonium salt, highly concentrated halogen ions and halogen gases are generated in an anode solution. As a result, the anode itself formed of a metal such as platinum is corroded by the halogen ions and halogen gases. The products of said corrosion permeate the ion exchange membrane and are carried into a cathode solution, thereby decreasing the purity of the quarternary ammonium hydroxide, and further deteriorating the synthetic resin anode material and cation exchange membrane during the above-mentioned electrolysis. Particularly, the cation exchange membrane, formed of polystyrene, is not applicable at all. Even a cation exchange membrane prepared from highly durable fluorocarbons noticeably deteriorates with time and can not withstand long use.

When a sulfate is applied as a quarternary ammonium salt, not only the drawbacks described in items (1) and (2) are experienced, but also the following problem arises in that difficulties are encountered in handling the extremely harmful alkyl sulfate used as a raw material in the manufacture of the subject quarternary ammonium hydroxide.

In view of the above-mentioned circumstances, patent application disclosure Sho 57-155390 sets forth a method of manufacturing quarternary ammonium hydroxide by electrolyzing quarternary ammonium salt such as acetic tetramethyl ammonium in the aforementioned electrolytic cell. This proposed method can indeed eliminate the difficulties mentioned under items (1) and (2) to manufacture quarternary ammonium hydroxide of high purity. Nevertheless, said disclosed method is still accompanied with the drawback that the quarternary ammonium salt manufactured by said method has a low industrial productivity, that is, a low yield, thereby inevitably increasing the overall cost of the quarternary ammonium hydroxide.

SUMMARY OF THE INVENTION

It is accordingly the object of this invention to provide a method of manufacturing high purity quarternary ammonium hydroxide at a low cost which eliminates the corrosion of an electrode during electrolysis and the deterioration of an ion exchange membrane, and which ensures the excellent stability of said quarternary ammonium hydroxide when stored in a stainless steel vessel.

To attain the above-mentioned object, this invention provides a method of manufacturing quarternary ammonium hydroxide by electrolyzing quarternary ammonium salt in an electrolytic cell whose diaphragm is made of a cation exchange membrane. The quarternary ammonium salt applied in the above-mentioned manufacturing method is represented by an organic acid salt which can be expressed by the general structural formula:

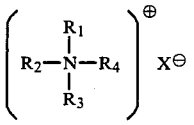

where $R_1$ to $R_4$ = methyl radical or ethyl radical (at least $R_1$ to $R_3$ denotes the same radical; X represents formic acid).

The quarternary ammonium salt expressed by the above structural formula concretely involves tetramethyl ammonium formate, tetraethyl ammonium formate, trimethyl ethyl ammonium formate, and triethylmethyl ammonium formate. A quarternary ammonium salt, for example, tetramethyl ammonium formate is synthesized by reacting trimethylamine $(CH_3)_3N$ with methyl formate ($HCOOCH_3$) in a solvent such as methyl alcohol or ethyl alcohol.

When an aqueous solution of the above-mentioned quarternary ammonium salt held in the anode chamber of an electrolytic cell whose diaphragm is made of a cation exchange membrane is impressed with D.C. voltage for electrolysis, the quarternary ammonium ion permeates the cation exchange membrane and enters the anion chamber of said electrolytic cell to produce quarternary ammonium hydroxide. At this time, hydrogen is generated at the cathode, while at the anode, the formic acid is decomposed by anodization, eventually giving rise to the formation of carbonic gas.

The above-mentioned cation exchange membrane should preferably be made of a highly durable material, for example, of the fluorocarbon series. The manufacturing method of this invention which involves the use of a quarternary ammonium salt exerting substantially no harmful effect on the cation exchange membrane to allow for the application of a membrane prepared from an inexpensive material of the polystyrene or polypropylene series.

An anode held in the aforementioned electrolytic cell can be formed of, for example, a high purity graphite electrode or a titanium electrode coated with an oxide of a material belonging to the platinum group. A cathode used with said electrolytic cell is prepared from, for example, alkali-resistant stainless steel or nickel.

Electrolysis in the above-mentioned electrolytic cell is carried out by impressing D.C. voltage between the anode and cathode with the current density controlled 1 to 50 A/dm$^2$ or preferably 3 to 40 A/dm$^2$. At this time, the temperature of the electrolyte should preferably be held within the range of 10° to 50° C. With the method of the present invention, an aqueous solution of a quarternary ammonium salt is supplied by circulation. The retention time of a liquid in the anode chamber and cathode chamber is controlled to fall within 60 seconds or preferably to from 1 to 10 seconds. In this case, an aqueous solution of a quarternary ammonium salt carried into the anode chamber should have a lower concentration that 60% by weight or preferably a concentration falling within the range of 5 to 40% by weight. Demineralized water has low electric conductivity. When therefore, the demineralized water is supplied to the cathode chamber, difficulties arise in commencing electrolysis at the start of manufacturing the subject quarternary ammonium salt. It is therefore preferred to apply a demineralized water to which about 0.01 to 1.0% by weight of quarternary ammonium hydroxide is added.

This invention is intended to manufacture high purity quarternary ammonium hydroxide. Therefore, it is preferable to not only apply highly purified raw quarternary ammonium salt and demineralized water, but also to fully clean, for example, the constituent members of the electrolytic cell and the storage tanks of the circulating liquid. It is also preferable that the electrolytic cell and storage tank be sealed with a high purity inert gas in order to prevent impurities from being carried into said electric cell and storage tank from outside of the manufacturing system.

DETAILED DESCRIPTION OF THE PREFERRED EMBODIMENT

This invention will become more apparent with reference to the following examples.

EXAMPLE 1

The raw material of quarternary ammonium hydroxide was prepared by dissolving 124 g (about 2.1 mol) of trimethyl amine and 126 g (about 2.1 mol) of methyl formate in 200 g of methyl alcohol. The components of said raw material were reacted with each other under the condition shown in Table 1 below, manufacturing tetramethyl ammonium formate.

EXAMPLE 2

The raw material of quarternary ammonium hydroxide was prepared by dissolving 115 g (about 1.95 mol) of trimethyl amine and 117 g (about 1.95) of methyl formate in 200 g of methyl alcohol. The components of said raw material were reacted with each other under the condition set forth in Table 1 below, manufacturing tetramethyl ammonium formate.

Control 1

The raw material of quarternary ammonium hydroxide was prepared by dissolving 125 g (about 2.1 mol) of trimethyl amine and 126 g (about 2.1 mol) of methyl acetate in 160 g of methyl alcohol. The components of said raw material were reacted with each other under the condition shown in Table 1 below, manufacturing tetramethyl ammonium acetate.

Control 2

The raw material of quarternary ammonium hydroxide was prepared by dissolving 139 g (about 2.35 mol) of trimethyl amine and 174 g (about 2.35 mol) of methyl acetate in 160 g of methyl alcohol. The components of said raw material were reacted with each other under the condition indicated in Table 1 below, manufacturing tetramethyl ammonium acetate.

A determination was made of the amount and percentage of tetramethyl ammonium formate produced in Examples 1 and 2 and also the amount and percentage of the tetramethyl ammonium acetate obtained in Controls 1 and 2. The results of said determination are set forth in Table 1 below.

TABLE 1

| | Condition of reaction | | | | |
|---|---|---|---|---|---|
| | Reaction pressure (kg/cm$^2$) | Reaction temperature (°C.) | Reaction time (hr) | Amount produced (g) | Percentage of production (%) |
| Example 1 | 7.5 to 10.4 | 98 to 116 | 6.5 | 167 | 66.7 |
| Example 2 | 8.9 to 13.2 | 100 to 116 | 6.5 | 164 | 70.6 |
| Control 1 | 6.0 to 8.5 | 109 to 122 | 6.5 | 41 | 14.9 |
| Control 2 | 7.2 to 14.0 | 116 to 143 | 6.5 | 84.4 | 27.0 |

As seen from Table 1 above, the tetramethyl ammonium formate produced in Examples 1 and 2 indicate a far higher yield than the tetramethyl ammonium acetate obtained in Controls 1 and 2.

EXAMPLE A

An electrolytic cell was provided which was constructed by stretching an ion exchange membrane prepared from a material belonging to the fluorocarbon series (manufactured by DuPont under the trademark "Nafion 324") between a polypropylene anode chamber holding a graphite anode and a cathode chamber holding a cathode prepared from stainless steel (SUS 304). Therefore, 1.3 mol/l of an aqueous solution of tetramethyl ammonium formate obtained by dissolving tetramethyl ammonium formate produced in Example 1 is demineralized water was circulated through the anode chamber of said electrolytic cell with the retention time set at 2.5 seconds. An aqueous solution of 0.01 mol/l of tetramethyl ammonium hydroxide was circulated through the cathode chamber with the retention time set at 2.5 seconds. Thereafter electrolysis was continued for about 70 hours by impressing a D.C. voltage 13 V between the anode and cathode, with the current set at 1.5 amperes on the average, thereby manufacturing 1.1 mol/l of an aqueous solution of tetramethyl ammonium hydroxide.

Control A 1.3 mol/l of an aqueous solution of tetramethyl ammonium acetate obtained by dissolving tetramethyl ammonium acetate produced in Control 1 in demineralized water was circulated through the anode chamber of the same type of electrolytic cell as used in Example A, with the retention time set at 2.5 seconds. Also 0.01 mol/l of an aqueous solution of tetramethyl ammonium hydroxide was circulated through the cathode chamber of said electrolytic cell with the retention time at 2.5 seconds. Thereafter, electrolysis was continued for about 70 hours by impressing a D.C. voltage of 13 V between the anode and cathode with the current set at 1.5 amperes on the average, thereby manufacturing 1.1 mol/l an aqueous solution of tetramethyl ammonium hydroxide.

Control B

Electrolysis was carried out for 70 hours under substantially the same condition as in Example A, except that 1.3 mol/l of an aqueous solution of tetramethyl ammonium chloride was used as an aqueous solution of quarternary ammonium salt hydroxide, thereby producing tetramethyl ammonium hydroxide having the same concentration as in Example A.

A determination was made of the amount of conducted current and average current efficiency when an aqueous solution of tetramethyl ammonium hydroxide was manufactured in Example A, and Controls A and B. The results of said determination showed that in Example A, the amount of conducted current was 3.5 F, and the average current efficiency was 77%. In Control A, the amount of conducted current was 4.3 F, and the average current efficiency was 65%. In Control B, the amount of conducted current was 4.0 F, and the average current efficiency was 68%. A Determination was also made of the concentration of impurities in the aqueous solutions of tetramethyl ammonium hydroxide obtained in Example A and Controls A and B, the results of said determination being set forth in Table 2 below.

TABLE 2

| | Impurities | | | | | | | |
|---|---|---|---|---|---|---|---|---|
| | Cl | Na | Fe | Ni | Cr | Ca | Al | Mg, Mn, Zn, Cu, Co |
| Example A | 0 | 6 ppb | 6 ppb | less than 1 ppb | less than 1 ppb | 3 ppb | 2 ppb | less than 1 ppb |
| Control A | 0 | 6 ppb | 7 ppb | less than 1 ppb | less than 1 ppb | 5 ppb | 2 ppb | less than 1 ppb |
| Control B | 10 ppm | 7 ppb | 9 ppb | less than 1 ppb | less than 1 ppb | 5 ppb | 2 ppb | less than 1 ppb |

Table 2 above shows that an aqueous solution of tetramethyl ammonium formate obtained in Example A and an aqueous solution of tetramethyl ammonium acetate produced in Control A had a far higher purity with the Cl concentration in mind than in aqueous solution of tetramethyl ammonium hydroxide manufactured by electrolyzing the aqeuous solution of tetramethyl ammonium chloride prepared in Control B.

Example A and Control B were run at 20 times and then the aqueous solution of tetramethyl ammonium hydroxide in Example A was examined for Cl and Ee concentrations. As a result, the Cl and Fe concentrations indicated a zero level and a very low level of 8 ppb, respectively, for the aqueous solution of the tetramethylammonium hydroxide in Example A and the Cl and Fe concentrations stood at a high level of 550 ppm and 60 ppb, respectively, for the aqueous solution of tetramethylammonium hydroxide in Control B.

Furthermore, Example A and Control B were run several times and then an aqueous solution of tetramethylammonium hydroxide was run and then examined for Fe concentration after stored in the respective stainless steel vessel at 60° for 30 days, noting that the Cl and Fe concentrations indicate a zero level and 7 ppb, respectively, for Example A and 100 ppm and 20 ppb, respectively for Control B. The results of said determination show that in Example A, a concentration of Fe. The result of said determination disclosed that in Example A, the concentration of Fe stood at 10 ppb, a level little changed from that of the initial storage, whereas in Control B, the concentration of Fe indicated 150 ppb, a level noticeably higher than that of the initial storage.

EXAMPLE B

Electrolysis was carried out substantially under the same condition as in Example A, except for the application of an electrolytic cell which was constructed by interposing a cation exchange membrane of polystyrene (manufactured by Tokuyama Soda K.K. under the tradename: C66-10F). Thus as aqueous solution of tetramethyl ammonium hydroxide was produced with the same concentration (1.1 mol/l) as in example A. At this time, the amount of conducted electric current was 3.7 F, and the average current efficiency was 76%.

A determination was made of the concentration of impurities in the produced aqueous solution of tetramethyl ammonium hydroxide. Said determination shows the following result:

| Name of impurities | Concentration (ppb) |
|---|---|
| Na | 7 |
| Fe | 8 |
| Ca | 4 |
| Al | 2 |
| Ni, Cr, Mg, Cu, Zn, Co | less than 1 |

As mentioned above, the method of this invention enbles a high purity aqueous solution of tetramethyl ammonium hydroxide to be manufactured even when applying a cation exchange membrane prepared from polystyrene of low durability, without any noticeable deterioration of said cation exchange membrane.

Namely, the present invention offers the advantages that the raw organic acid salt (quaternary ammonium salt expressed by the previously described general structural formula) can be synthesized with good yield; the corrosion of an electrode and the deterioration of a cation exchange membrane can be eliminated when said quarternary ammonium salt is electrolyzed; and it is possible to manufacture at low cost, high purity quaternary ammonium hydroxide which exhibits excellent stability when stored in a stainless steel vessel.

What is claimed is:

1. A method of manufacturing tetramethyl ammonium hydroxide by electrolyzing a tetramethyl ammonium salt in an electrolytic cell the diaphragm of which is prepared from a cation exchange membrane wherein said tetramethyl ammonium salt is tetramethyl ammonium formate prepared by a reaction between trimethylamine and methyl formate in either methyl alcohol or ethyl alcohol, solvent.

* * * * *